United States Patent [19]

Maag

[11] Patent Number: 4,828,254

[45] Date of Patent: May 9, 1989

[54] CRANK AND SLIDER/FOUR-BAR VARIABLE RESISTANCE CARRIAGE-TYPE LEG PRESS MACHINE

[76] Inventor: Henry Maag, 5332 Clark Cir., Westminster, Calif. 92683

[21] Appl. No.: 190,047

[22] Filed: May 4, 1988

[51] Int. Cl.[4] ..... A63B 21/00

[52] U.S. Cl. ..... 272/134; 272/117

[58] Field of Search ..... 272/117, 118, 134, 130, 272/138

[56] References Cited

U.S. PATENT DOCUMENTS

| | | | |
|---|---|---|---|
| 3,622,154 | 11/1971 | Williams | 272/134 |
| 3,866,914 | 2/1975 | Jackson | 272/117 |
| 4,333,644 | 6/1982 | Lambert, Jr. et al. | 272/118 |
| 4,336,934 | 6/1982 | Hanagan et al. | 272/117 |
| 4,357,010 | 11/1982 | Telle | 272/117 |
| 4,535,985 | 8/1985 | Mask | 272/134 |

*Primary Examiner*—Richard J. Apley
*Assistant Examiner*—J. Welsh

[57] ABSTRACT

A carriage-type leg press exercise machine which applies a pre-determined variably resistive force to an operator's thigh and hip extending muscles through the use of a kinematically derived double-rocking-lever four-bar linkage, whose rocking follower lever constitutes a rotating weight arm to which weights are loaded and whose rocking driver lever is mechanically linked to an operator-engaging guided-carriage assembly which slides along the path of the leg press exercise movement, as is conventional.

3 Claims, 6 Drawing Sheets

CRANK AND SLIDER/FOUR-BAR VARIABLE RESISTANCE CARRIAGE-TYPE LEG PRESS MACHINE

This invention relates to exercise equipment, in particular to a leg press exercise machine which utilizes an operator-engaging guided-carriage which is mechanically linked to a four-bar linkage / rotating weight arm force-varying mechanism which applies a variably resistive force to an operator's leg pressing muscles via operator body-machine contact with the guided-carriage throughout the range of the exercise movement.

BACKGROUND AND OBJECTIVE OF THE INVENTION

Present day carriage-type leg press machines all work on the same primary principle of fixing the positions of either the operator's ankle joints or the operator's hip joints while applying a resistive force, through the use of an operator-engaging guided-carriage assembly, to the operator's opposite nonconstrained pair of hip or ankle joints which tends to make these two pairs of joints move toward each other along the lines between them. The operator's leg extending muscles (quadriceps femoris) and hip extending muscles (gluteus maximus) are developed as they oppose this force by tending to move these two pairs of joints apart during the exercise movement.

It is a well known fact and easily verified that due to joint mechanics, angles of pull of muscles, physiological make-up of muscles, etc. that in a leg press movement (combined hip and knee joint extension) more force can be applied as the legs become more extended to the point of lockout. Consequently, a leg press machine which varies the resistive force applied to correspond with the positionally related strength capabilities of the operator's leg pressing muscles will be more effective at developing those muscles.

The standard method of varying the resistive force applied on present day carriage-type leg press machines is through the use of cams used in conjunction with chains or cables, all of which have inherent problems. The problem with cams is that they are relatively hard to manufacture. The problem with cables is that because of their relatively small cross sectional area they carry very high tensile stresses (a ⅝" cable carrying 200 lbs, for example, has a tensile stress in it of approximately 16,300 psi). These already high stresses are multiplied and become cyclic (introducing fatigue wear) when a cable moves along bending over a small diameter pulley. These high cyclic stresses applied to relatively small cross sectional areas make cables stretch (eventually decreasing the machine's intended range of motion) and eventually fray and wear out (leading to replacement or catastropic failure). Chains, while not suffering the fatigue wear that cables do, are subject to stretching at their many joints (thus decreasing the machine's intended range of motion). They, also like cables, are subject to relatively high tensile stresses and in addition are noisy and introduce spurious drag to the machine.

In view of the advantage of applying a variably resistive force to an operator's leg pressing muscles in a leg press exercise movement, and the disadvantages of obtaining such a force through the use of cams, chains, or cables, it is the objective of the disclosed invention to introduce a carriage-type leg press machine which applies a pre-determined variably resistive force to an operator's leg pressing muscles through the use of a force-varying mechanism which uses only rigid members and pinned joints, thereby eliminating the problems associated with force-varying mechanisms using cams, chains, or cables.

SUMMARY OF THE INVENTION

The machine disclosed in this application has two configurations both of which share the same features and operate on the same principle, differing only in which pair of the operator's joints (ankle or hip) are fixed and which pair of joints (hip or ankle) the resistive force is applied to while performing the exercise. Both configurations consist of a stable frame which contains provision for fixing the positions of either the operator's ankle joints (fixed ankle-free hip configuration) or the operator's hip joints (fixed hip-free ankle configuration) as by means of either a frame-attached foot-e (fixed ankle-free hip configuration) or frame-attached back and seat engaging pads (fixed hip-free ankle configuration). Slideably-mounted to the machine's frame, so as to move along a linear path which extends away from the provisions for fixing the operator's ankle or hip joints, is a carriage assembly which includes provisions for applying resistive force to either the operator'non-constrained hip joints (fixed ankle-free hip configuration) or the operator's non-constrained ankle joints (fixed hip-free ankle configuration) as by means of either carriage-attached shoulder and back engaging pads (fixed ankle-free hip configuration) or a carriage-attached foot-engaging platform (fixed hip-free ankle configuration). Journaled in the machine's frame, on a horizontal axis which is both perpendicular with and offset from the linear path which the carriage assembly moves along, is a rotating effort arm which is mechanically linked to the guided-carriage assembly by a rigid connecting link which joins between an axis of connection on the rotating effort arm which moves through an arc which approximates the line which the axis of connection on the guided-carriage assembly moves along throughout the exercise movement. Also journaled in the machine's frame on a horizontal axis which is both parallel with and offset by a specific distance from the axis of rotation of the rotating effort arm is a rotating weight arm which contains provision for loading weights onto at a point offset from its axis of rotation. The rotating effort arm and the rotating weight arm are mechanically linked to each other at axes which are both parallel with and offset by specific distances from their respective axes of rotation by a rigid connecting link which also has a specific length between its centers of connection. The rotating effort arm, the rotating weight arm, the link joining them, and the frame of the machine join together to form a double-rocking-lever four-bar linkage which acts in conjunction with both the rotating weight arm and the crank & slider linkage (formed by the guided-carriage assembly, the rotating effort arm, and the link joining them) to vary the resistive force applied to the operator's thigh and hip extending muscles through body-machine contact with the guided-carriage assembly throughout the exercise movement. Through a simple kinematic analysis the specific lengths and orientations of the moving parts which constitute the double-rocking-lever four-bar linkage, the crank & slider linkage, and the rotating weight arm can be specified to apply a load, at the body-machine contact surfaces on the guided-carriage assembly, which varies in accordance with the normal strength-to-position force-applying capabilities of the average operator in the leg press exercise movement.

This invention, through the use of kinematically derived and specified four-bar linkage acting in conjunction with a rotating weight arm and a crank & slider linkage which together use only rigid members and pinned joints, applies a pre-determined variably resistive force to an operator's thigh and hip extending muscles throughout the range of the leg press exercise movement without the use of cams, chains, or cables, thereby fulfilling its objective.

DESCRIPTION OF THE PREFERRED EMBODIMENTS

Figure 1:
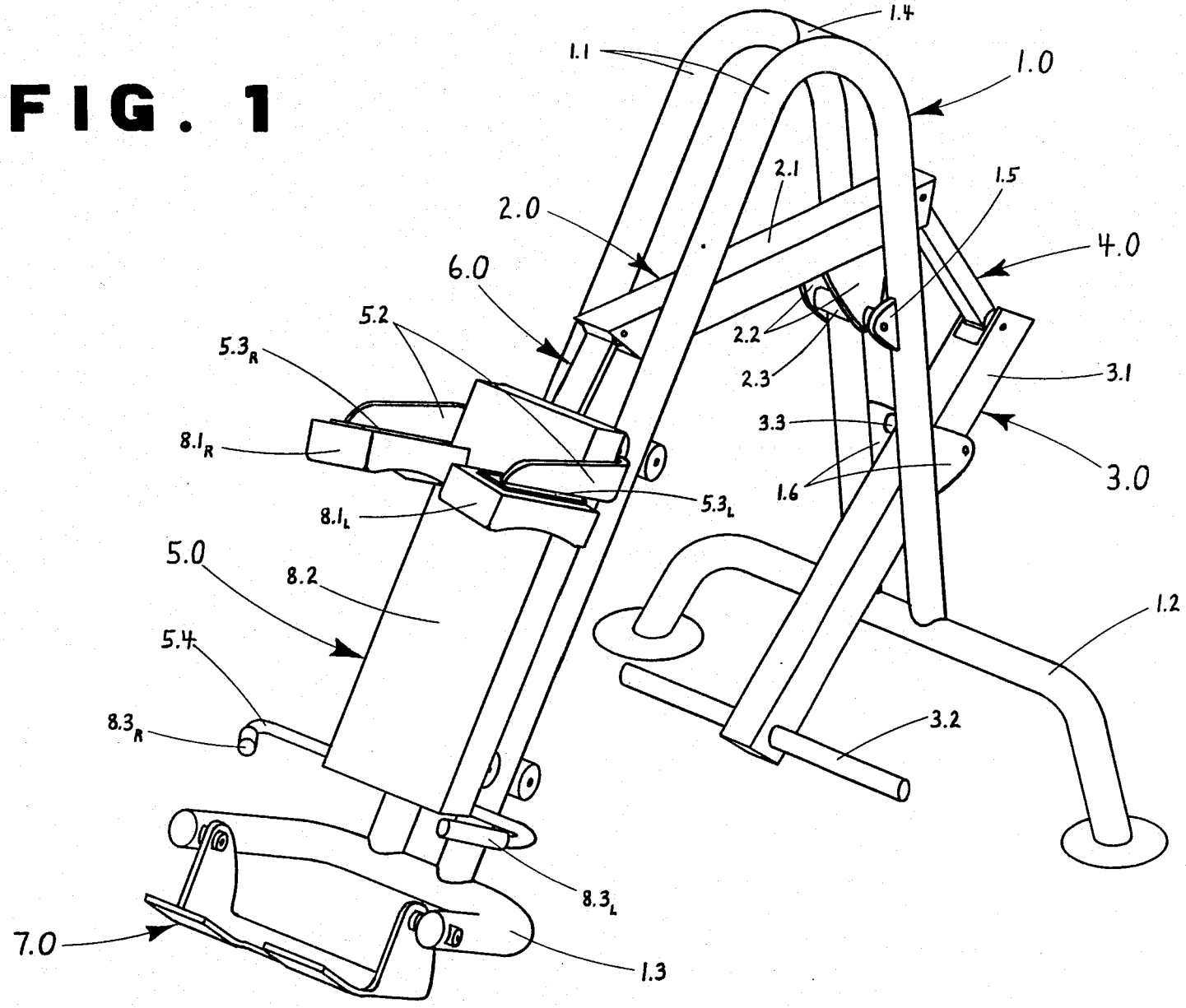
FIG. 1 is a pictorial view of the preferred configuration embodiment of the fixed ankle-free hip configuration of the disclosed carriage-type leg press exercise machine with all parts labeled.
Figure 2:
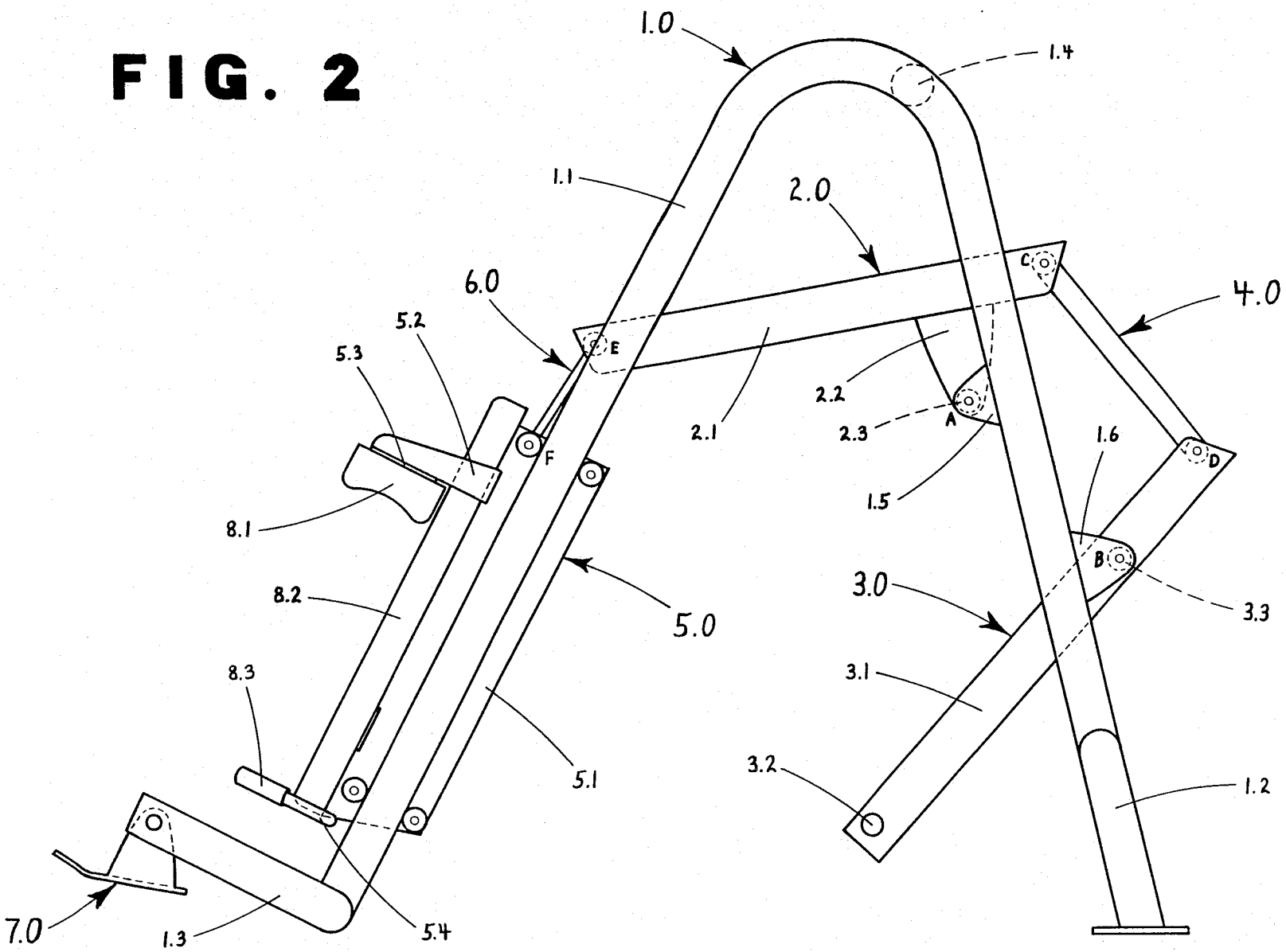
FIG. 2 is a side view of the preferred configuration embodiment of the fixed ankle-free hip configuration of the disclosed carriage-type leg press exercise machine with all parts labeled.
Figure 3:
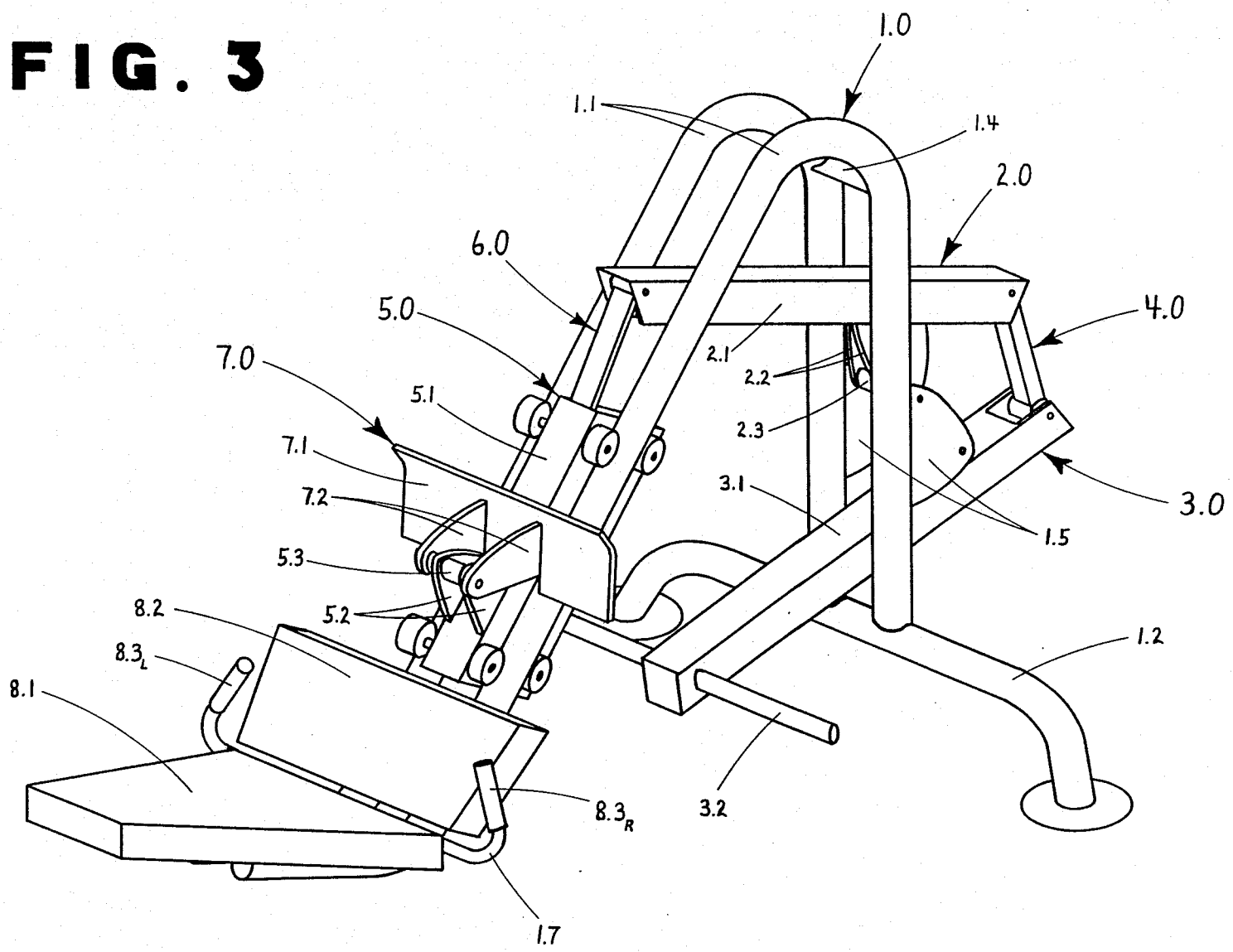
FIG. 3 is a pictorial view of the preferred configuration embodiment of the fixed hip-free ankle configuration of the disclosed carriage-type leg press exercise machine with all parts labeled.
Figure 4:
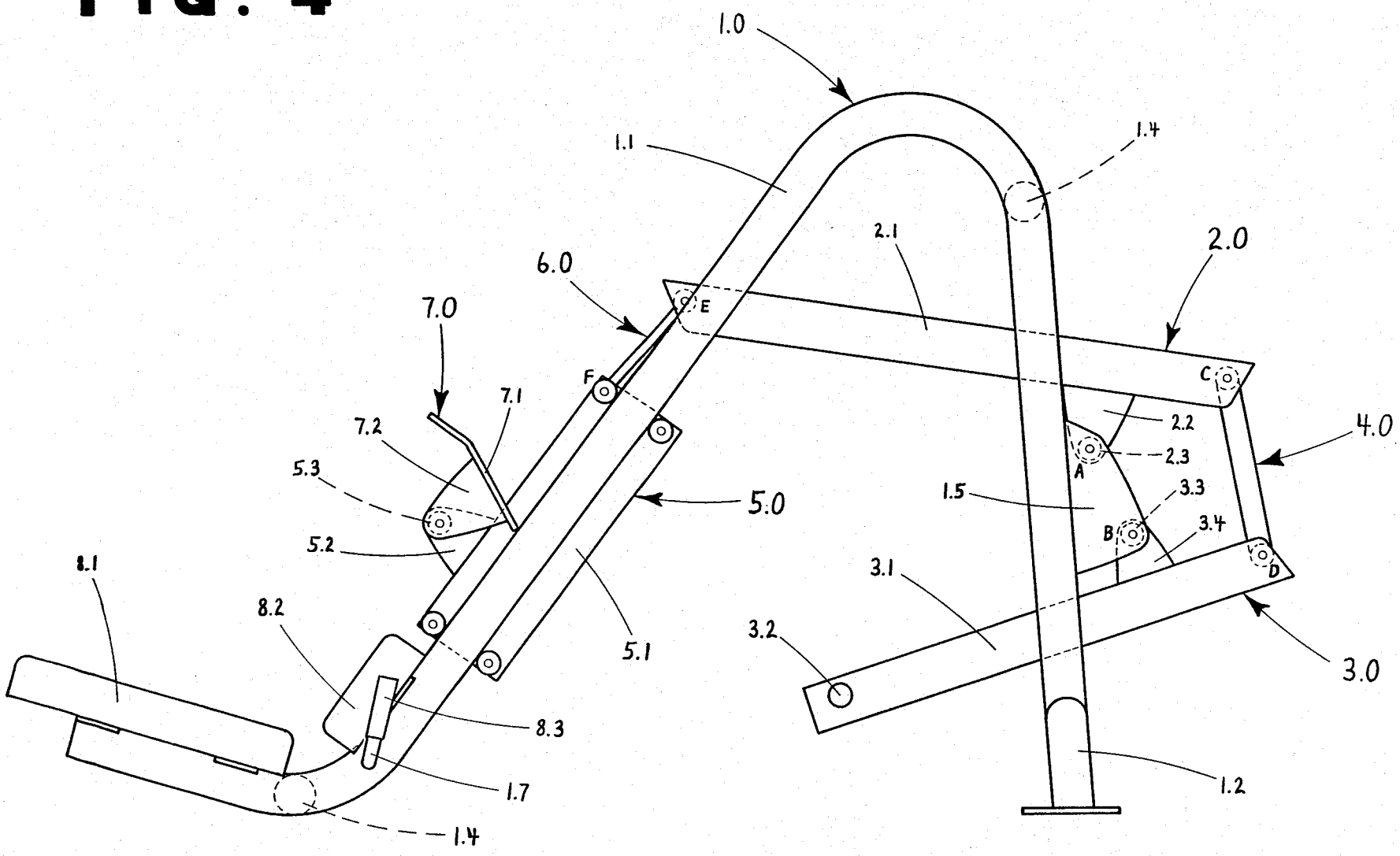
FIG. 4 is a side view of the preferred configuration embodiment of the fixed hip-free ankle configuration of the disclosed carriage-type leg press exercise machine with all parts labeled.

Refer now in detail to FIGS. 1 & 2 which show corresponding pictorial and side views of the fixed ankle-free hip configuration of the disclosed invention and FIGS. 3 & 4 which show corresponding pictorial and side views of the fixed hip-free ankle configuration of the disclosed invention. The primary frame of both configurations of this invention (assembly 1.0) consist of two inverted "V" shaped round steel tubes (parts 1.1) which lie in parallel vertical planes which are symmetrical about the machine's plane of symmetry and separated by about 8". As shown in FIGS. 1 & 2, these two parallel tubes have single bends and are truely "V" shaped in the fixed ankle-free hip configuration while their forward legs each have a second bend leading to a short back pad support leg in the fixed hip-free ankle configuration, as shown in FIGS. 3 & 4. In both configurations, these two parallel "V" shaped round steel tubes join perpendicularly at their lower rearward open ends into a transverse wide "flat U" shaped stabalizing tube (part 1.2) which lies in the plane established by the two rearward parallel legs of parts 1.1, as shown in the respective configuration's figures. In the fixed ankle-free hip configuration (FIGS. 1 & 2) a "narrow U" shaped tube (part 1.3), which lies in a plane which is perpendicular to the plane established by the forward parallel legs of parts 1.1, is transversely attached to the lower forward open ends of parts 1.1, and a short connecting tube (part 1.4) is attached transversely between parts 1.1 near the upper bend portions of parts 1.1, as shown in FIGS. 1 & 2. In the fixed hip-free ankle configuration (FIGS. 3 & 4) two short connecting tubes (parts 1.4) are attached transversely between parts 1.1, one near the lower forward bend portions and the other near the upper bend portions of parts 1.1, as shown in FIGS. 3 & 4. These five respective steel tubes join together to form a single, stable frame for the respective configurations of the disclosed invention when welded together as shown and described.

Both configurations of the invention contain an operator-engaging guided-carriage assembly (assembly 5.0) which is slideably attached to the two forward parallel legs of parts 1.1 on four sets of three wheels which are mounted to part 5.1 so as to engage the forward, rearward, and inward sides of the forward legs of parts 1.1 so as to translate up and down the lengths of parts 1.1, as is conventional. The body of this carriage assembly is composed of a large rectangular steel tube (part 5.1) which travels between the forward legs of parts 1.1 at both the top and bottom of part 5.1, as is conventional. Operator-engaging force-transmitting contact surfaces are attached to this guided-carriage assembly on both configurations of the machine. On the fixed ankle-free hip configuration (FIGS. 1 & 2) these operator-engaging force-transmitting contact surfaces consist of two pads (parts $\mathbf{8.1}_R$ & $\mathbf{8.1}_L$) which engage the tops of the operator's respective right and left shoulders and are joined to the guided-carriage assembly by two respective steel plates (parts $\mathbf{5.3}_R$ & $\mathbf{5.3}_L$) which are welded to the bottom sides of the two respective legs of a "U" shaped bracket (part 5.2) which is centered on the assembly's plane of symmetry and joins perpendicularly to the upper forward end of part 5.1, as shown in FIGS. 1 & 2. On the fixed hip-free ankle configuration (FIGS. 3 & 4) these operator-engaging force-transmitting contact surfaces consist of the two sides of an elongated rocking foot-engaging plate (part 7.1) which engages the bottoms of the operator's respective right and left feet. This rocking foot-engaging plate is pivotally attached to the body of the carriage assembly so as to rotate on an axis which is approximately common with the axes through the operator's ankle joints while performing the exercise, by a steel pin which both inserts through the two foot plate attached flanges (parts 7.2) and journals through bearings inserted in a bearing tube (part 5.3) which is attached to the guided-carriage assembly's body by the carriage-attached flanges (parts 5.2). In addition to the shoulder-engaging contact surfaces, the fixed ankle-free hip configuration's carriage assembly also contains an operator back support pad (part 8.2) and handgrips (parts $\mathbf{8.3}_R$ & $\mathbf{8.3}_L$). The operator back support pad (part 8.2) is centered on the assembly's plane of symmetry and attached to the forward side of part 5.1 in such a position that it will engage and support the operator's back while performing the exercise. The pair of handgrips (parts $\mathbf{8.3}_R$ & $\mathbf{8.3}_L$) are attached to the ends of a "C" shaped handlebar (part 5.4) which is centered on the assembly's plane of symmetry and joined perpendicularly to the lower forward end of part 5.1 in such a position that the handgrips will engage the operator's hands while performing the exercise, as is conventional.

Both configurations of the invention contain an operator-engaging constraint surface which is located at the base of the two forward parallel legs of parts 1.1 in a position centered on and symmetrical about the machine's plane of symmetry. On the fixed ankle-free hip configuration (FIGS. 1 & 2) this operator-engaging constraint surface consist of an elongated rocking foot-engaging plate (part 7.0) whose short upwardly extending side legs contain short bearing plate tubes which journal bearings which engage steel pins which join the rocking foot-engaging plate to the machine's frame on an axis between the forward ends of the legs of the "short U" shaped loop (part 1.3) which corresponds approximately to the axes of rotation of the operator's ankles while performing the exercise. On the fixed hip-free ankle configuration (FIGS. 3 & 4) this operator-engaging constraint surface consist of an operator back-engaging pad (part 8.1) which is mounted to the top sides of the forward short straight portions of parts 1.1 as shown. In addition to this back constraint pad, the fixed hip-free ankle configuration's frame also contains an operator seat-engaging pad (part 8.2) and handgrips (parts $8.3_R$ & $8.3_L$). The operator seat-engaging pad (part 8.2) is centered on the machine's plane of symmetry and attached to the forward sides of the lower ends of the two forward parallel legs of parts 1.1 in such a position that it will engage and support the operator's seat while performing the exercise. The pair of handgrips (parts $8.3_R$ & $8.3_L$) are attached to the ends of a "C" shaped handlebar (part 1.7) which is centered on the machine's plane of symmetry and joined perpendicularly to the lower bend portions of parts 1.1 in such a position that the handgrips will engage the operator's hands while performing the exercise, as is conventional.

Figure 5A:
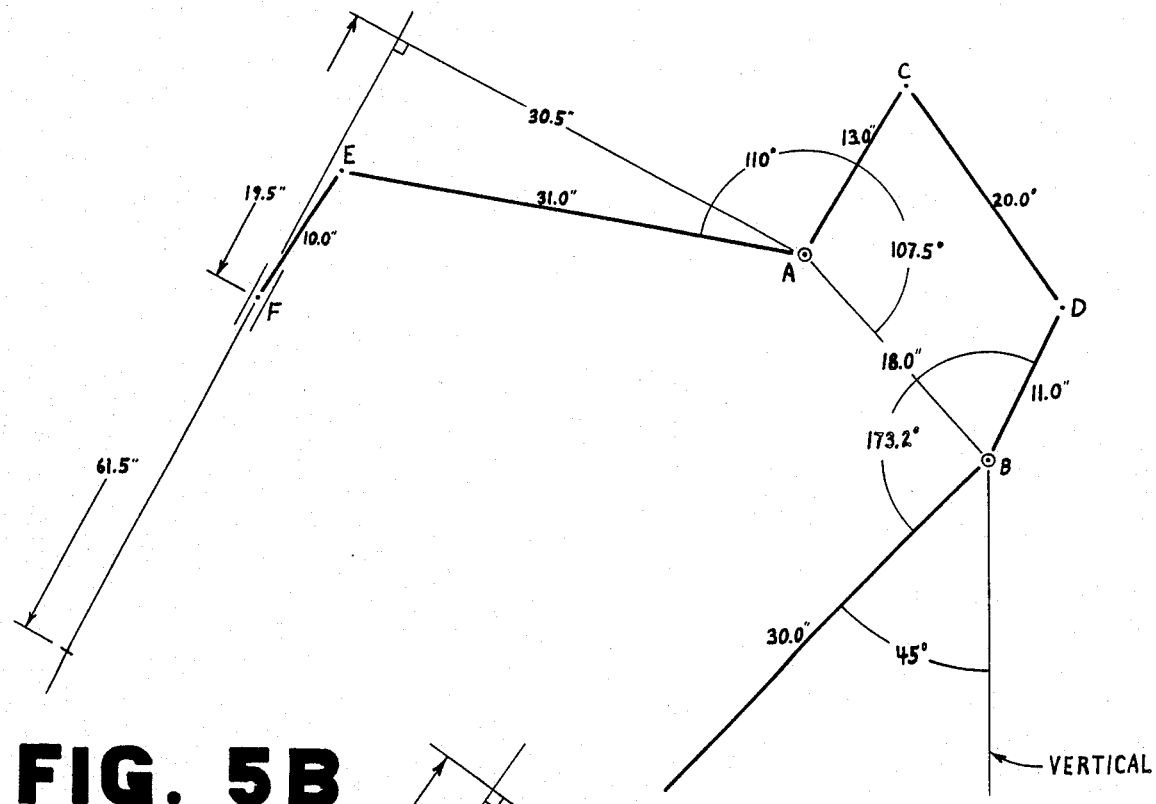
FIG. 5(A) is a kinematic view of the moving parts of the fixed ankle-free hip configuration showing all critical dimensions and angles at the starting position of the exercise movement.
Figure 5B:
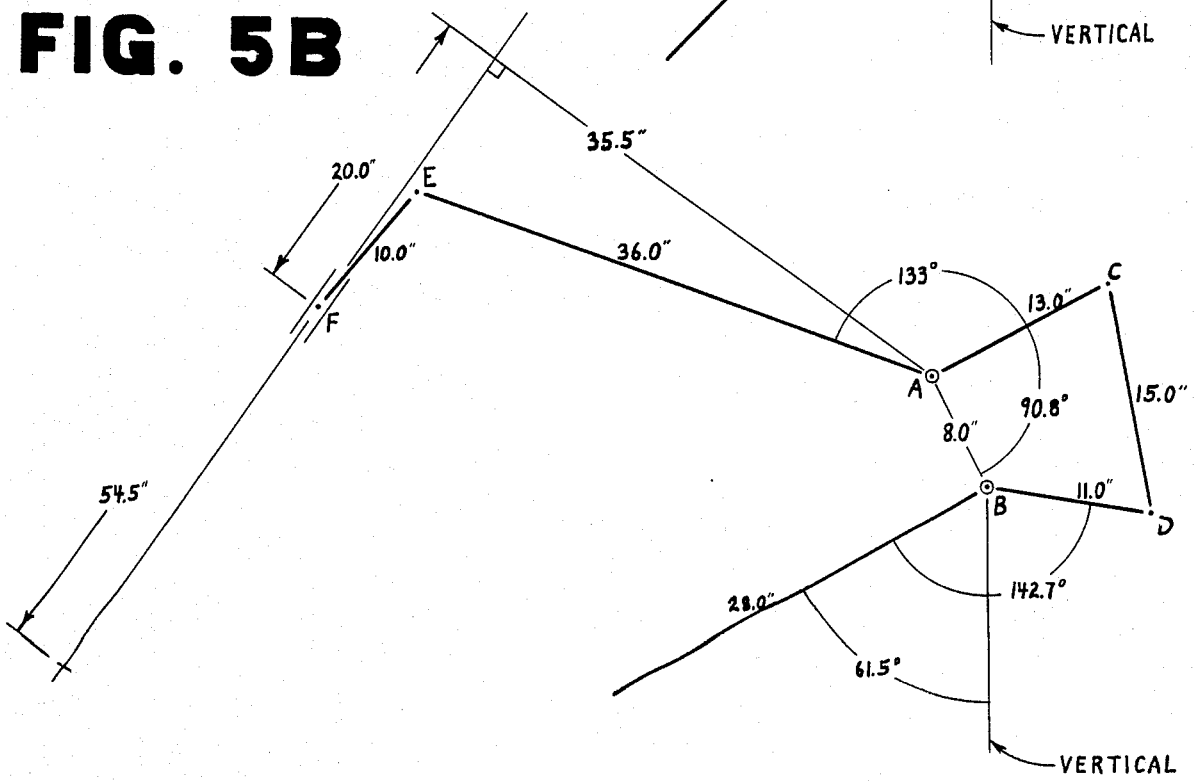
FIG. 5(B) is a kinematic view of the moving parts of the fixed hip-free ankle configuration showing all critical dimensions and angles at the starting position of the exercise movement.

Both configurations of the invention contain a rotating effort arm assembly (assembly 2.0) which rotates about a frame-journaled horizontal axis (axis A) which is both perpendicular with and offset from the line which the respective machine's guided-carriage assembly moves along. On the fixed ankle-free hip configuration (FIGS. 1 & 2) this rotating effort arm assembly is journaled in bearings which are centered on axis A in frame-attached flanges (parts 1.5) which are located on the forward sides of the rearward parallel sections of parts 1.1 in a position 30.5" away from the line which the axis of connection of the drive link to the guided-carriage assembly (axis F) moves along directed perpendicularly from a point 61.5" away from the point on the line which axis F moves along which is even with the axis through the operator's ankle joints as illustrated in FIG. 5A. On the fixed hip-free ankle configuration (FIGS. 3 & 4) this rotating effort arm assembly is journaled in bearings which are centered on axis A in the upper forward ends of frame-attached flanges (parts 1.5) which are located on the rearward sides of the rearward parallel sections of parts 1.1 in a position 35.5" away from the line which the axis of connection of the drive link to the guided-carriage assembly (axis F) moves along directed perpendicularly from a point 54.5" away from the point on the line which axis F moves along which is even with the axis through the operator's hip joints as illustrated in FIG. 5B.

The rotating effort arm assembly on both configurations of the invention (assembly 2.0) rotates on horizontal axis A in a position centered on the machine's plane of symmetry so as to pass between the rearward legs of parts 1.1 while rotating in the same plane which the body of the carriage assembly moves through. As shown in FIGS. 1 & 2, the rotating effort arm assembly on the fixed ankle-free hip configuration of the invention is composed of a rectangular steel tube (part 2.1) which is journaled to the machine's frame at axis A by a steel pin which both inserts through the frame-attached flanges (parts 1.5) and through bearings which are journaled in a bearing tube (part 2.3) which is joined to the lower side of part 2.1 by a pair of steel flanges (parts 2.2) as shown. As shown in FIGS. 3 & 4, the rotating effort arm assembly on the fixed hip-free ankle configuration of the invention is composed of a rectangular steel tube (part 2.1) which is journaled to the machine's frame at axis A by a steel pin which both inserts through the upper forward ends of the frame-attached flanges (parts 1.5) and through bearings which are journaled in a bearing tube (part 2.3) which is joined to the lower side of part 2.1 by a pair of steel flanges (parts 2.2) as shown. As shown in FIGS. 1, 2, 3, & 4, the rotating effort arm assembly on each of the two respective configurations of the invention contains two more axes (axes C & E) which are each parallel with, offset by a specific distance from, and specifically oriented to the axis of rotation of the respective rotating effort arm assembly of which they are a part. The first of these two offset axes (axis E) journals a steel pin which is used in connecting a connecting link from the rotating effort arm assembly at the forward end of part 2.1 to the guided-carriage assembly at axis F as shown. The second of these two offset axes (axis C) journals a steel pin which is used in connecting a connecting link from the rotating effort arm assembly at the rearward end of part 2.1 to the rotating weight arm assembly at axis D as shown. On the fixed ankle-free hip configuration the distance between axis A and axis E is 31.0", the distance between axis A and axis C is 13.0", and the angle formed between the line connecting axis E with axis A and the line connecting axis C with axis A is 110°as illustrated in FIG. 5A. On the fixed hip-free ankle configuration the distance between axis A and axis E is 36.0", the distance between axis A and axis C is 13.0", and the angle formed between the line connecting axis E with axis A and the line connecting axis C with axis A is 133° as illustrated in FIG. 5B.

As shown in FIGS. 1, 2, 3, & 4, the rotating effort arm assembly (assembly 2.0) and the guided-carriage assembly (assembly 5.0) on both configurations of the invention are mechanically linked to each other by a rigid connecting link (part 6.0) which consist of a rigid steel bar which contains parallel bushings at its opposite ends. One end of this connecting link connects by way of a steel pin (the upper forward axle of the respective configuration's guided-carriage assembly) to the respective configuration's guided-carriage assembly at axis F as shown. The opposite end of this connecting link connects by way of another steel pin, as mentioned earlier, to the respective configuration's rotating effort arm assembly at axis E as shown. The distance between the axes of the parallel bushings on this connecting link is 10.0" in both configurations, as shown in FIGS. 5A & 5B.

Both configurations of the invention contain a rotating weight arm assembly (assembly 3.0) which rotates about a frame-journaled horizontal axis (axis B) which is both parallel with and offset from the axis of rotation of the respective machine's rotating effort arm assembly (axis A). On the fixed ankle-free hip configuration (FIGS. 1 & 2) this rotating weight arm assembly is journaled in bearings which are centered on axis B in frame-attached flanges (parts 1.6) which are located on the rearward sides of the rearward parallel sections of parts 1.1. The distance between axis A and axis B on the fixed ankle-free hip configuration is 18.0" and the direction to axis B from axis A is downward and rearward along a line which forms a 107.5° angle with the line connecting axis A with axis C as measured when the rotating effort arm is in its starting position which corresponds to the point where axis F is 19.5" below the point of intersection of the line which axis F moves along with the line through axis A which is perpendicular to the line which axis F moves along as illustrated in FIG. 5A. On the fixed hip-free ankle configuration (FIGS. 3 & 4) this rotating weight arm assembly is journaled in bearings which are centered on axis B in the lower rearward ends of frame-attached flanges (parts 1.5) which are located on the rearward sides of the rearward parallel sections of parts 1.1. The distance between axis A and axis B on the fixed hip-free ankle configuration is 8.0" and the direction to axis B from axis A is downward and rearward along a line which forms a 90.8° angle with the line connecting axis A with axis C as measured when the rotating effort arm is in its starting position which corresponds to the point where axis F is 20.0" below the point of intersection of the line which axis F moves along with the line through axis A which is perpendicular with the line which axis F moves along as illustrated in FIG. 5B.

The rotating weight arm assembly on both configurations of the invention (assembly 3.0) rotates on horizontal axis B in a position centered on the machine's plane of symmetry so as to pass between the rearward legs of parts 1.1 while rotating in the same plane which both the rotating effort arm rotates in and the body of the carriage assembly moves through. As shown in FIGS. 1 & 2, the rotating weight arm assembly on the fixed ankle-free hip configuration of the invention is composed of a horizontal weight support bar (part 3.2) which is transversely joined to the forward end of a rectangular steel tube (part 3.1) which is journaled to the machine's frame at axis B by a steel pin which both inserts through the frame-attached flanges (parts 1.6) and through bearings which are journaled in a bearing tube (part 3.3) which is welded through its center as shown. As shown in FIGS. 3 & 4, the rotating weight arm assembly on the fixed hip-free ankle configuration of the invention is composed of a horizontal weight support bar (part 3.2) which is transversely joined to the forward end of a rectangular steel tube (part 3.1) which is journaled to the machine's frame at axis B by a steel pin which both inserts through the lower rearward ends of the frame-attached flanges (parts 1.5) and through bearings which are journaled in a bearing tube (part 3.3) which is joined to the upper side of part 3.1 by a pair of steel flanges (parts 3.4) as shown. As shown in FIGS. 1, 2, 3, & 4, the rotating weight arm assembly on each of the two respective configurations of the invention contains both a horizontal weight supporting bar at its forward end and a second axis (axis D) at its rearward end which journals a steel pin which is used in connecting a connecting link from the rotating weight arm assembly to the rotating effort arm assembly. Both the weight support bar and axis D lie on lines which are both parallel with, offset by specific distances from, and specifically oriented to the axis of rotation of the respective rotating weight arm assembly of which they are a part. On the fixed ankle-free hip configuration the distance between axis B and axis D is 11.0", the distance between axis B and the axis of the weight support bar is 30.0", and the angle formed between the line connecting the axis of the weight support bar with axis B and the vertical is 45° up from vertical at the beginning of the exercise stroke as illustrated in FIG. 5A. On the fixed hip-free ankle configuration the distance between axis B and axis D is 11.0", the distance between axis B and the axis of the weight support bar is 28.0", and the angle formed between the line connecting the axis of the weight support bar with axis B and the vertical is 61.5° up from vertical at the beginning of the exercise stroke as illustrated in FIG. 5B.

As shown in FIGS. 1, 2, 3, & 4, the rotating effort arm assembly (assembly 2.0) and the rotating weight arm assembly (assembly 3.0) on both configurations of the invention are mechanically linked to each other by a rigid connecting link (part 4.0) which consist of a rigid steel bar which contains parallel bushings at its opposite ends. One end of this connecting link connects by way of a steel pin, as mentioned earlier, to the respective configuration's rotating effort arm assembly at axis C as shown. The opposite end of this connecting link connects by way of another steel pin, as mentioned earlier, to the respective configuration's rotating weight arm assembly at axis D as shown. On the fixed ankle-free hip configuration the distance between the axes of the parallel bushings on this connecting link is 20.0" as illustrated in FIG. 5A. On the fixed hip-free ankle configuration the distance between the axes of the parallel bushings on this connecting link is 15.0" as illustrated in FIG. 5B.

Figure 6A:
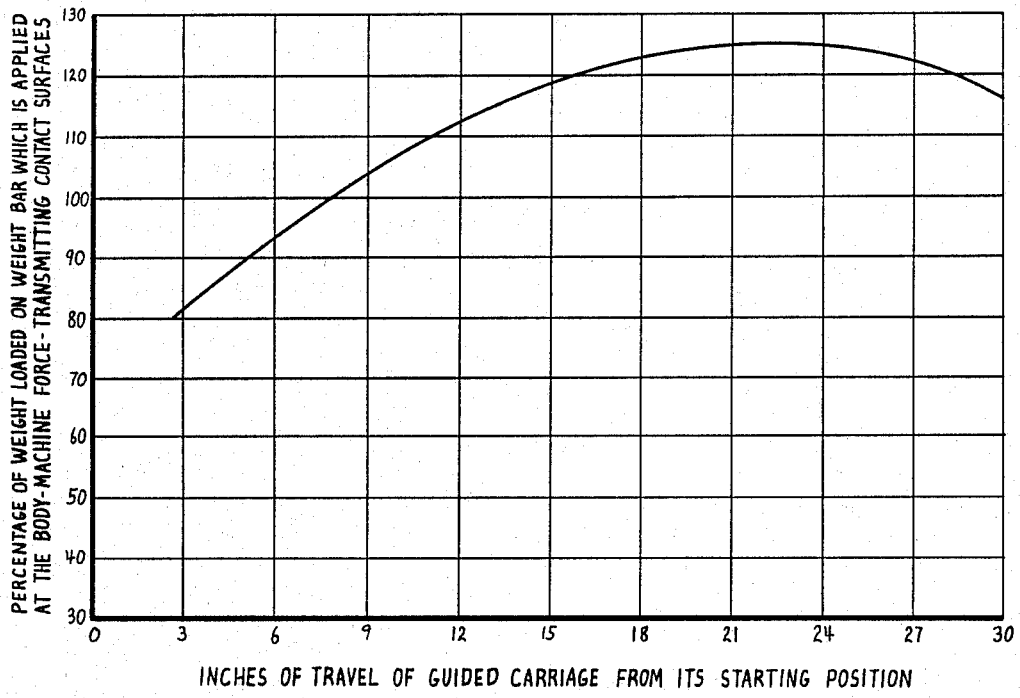
FIG. 6(A) is a graph generated from kinematic analysis of the fixed ankle-free hip configuration's force-varying mechanism composed of the moving parts shown in FIG. 5(A).
Figure 6B:
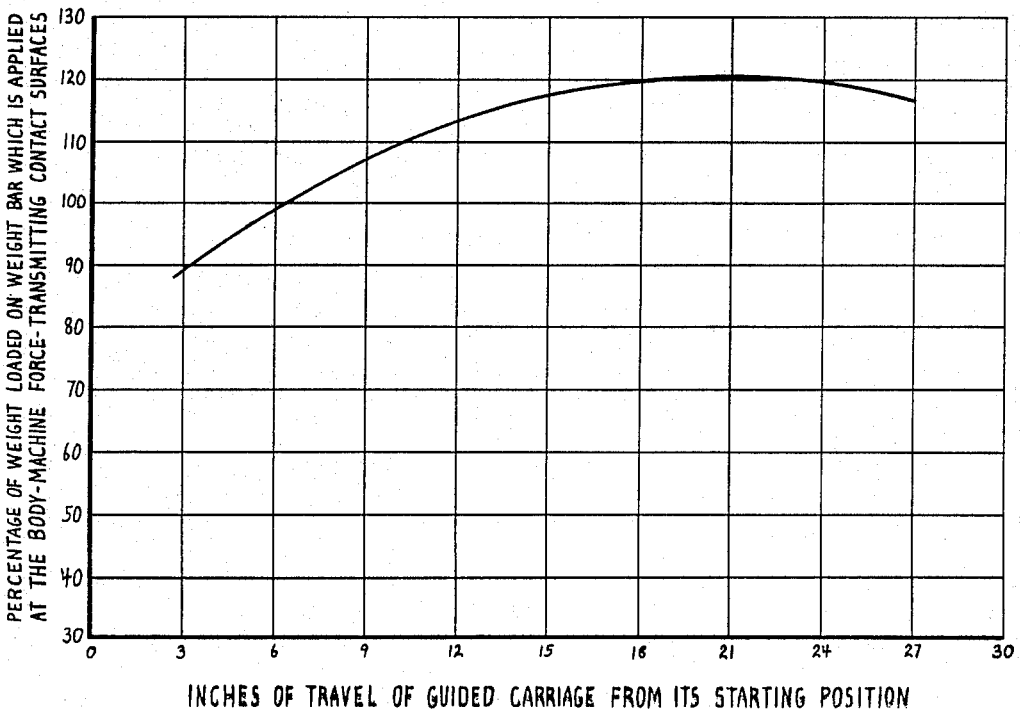
FIG. 6(B) is a graph generated from kinematic analysis of the fixed hip-free ankle configuration's force-varying mechanism composed of the moving parts shown in FIG. 5(B).

When the guided-carriage assembly (assembly 5.0), the rotating effort arm assembly (assembly 2.0), the rotating weight arm assembly (assembly 3.0), the links joining them (parts 4.0 & 6.0), and the frame of the machine (assembly 1.0) are all oriented as shown in FIGS. 5A & 5B for the respective configurations of the disclosed invention the corresponding output for the respective configurations as shown in the graphs in FIGS. 6A & 6B will be obtained.

HOW THE INVENTION WORKS

Like a typical carriage-type leg press machine, the exercising position is with the operator's ankle or hip joints (depending on the configuration) fixed by the machine's frame at the base of the guided-carriage assembly as by means of either the rocking foot-engaging plate (part 7.0, fixed ankle-free hip configuration) or by means of the operator back and seat engaging pads (parts 8.1 & 8.2, fixed hip-free ankle configuration) and the operator's opposite non-constrained hip or ankle joints (depending on the configuration) joined to the guided-carriage assembly as by means of either the carriage-attached shoulder and back engaging pads (parts 8.1 & 8.2, fixed ankle-free hip configuration) or by means of the carriage-attached rocking foot-engaging plate (part 7.0, fixed hip-free ankle configuration). From this position the exercise is performed by simultaneously contracting the thigh and hip extending muscles so as to move the guided-carriage up and down its line of travel. Unlike a typical variable-resistance carriage-type leg press machine, which either uses cams or wheels to drive cables or chains which are attached to the guided-carriage assembly, this machine's guided-carriage assembly (assembly 5.0) is driven by a rigid connecting link (part 6.0) which is driven by a rigid rotating effort arm assembly (assembly 2.0) which is driven by a second connecting link (part 4.0) which is driven by a rigid rotating weight arm assembly (assembly 3.0) which is driven by the force of gravity acting on weights which are loaded at its distal end.

The guided-carriage assembly (assembly 5.0), the rotating effort arm assembly (assembly 2.0), and the connecting link joining them (part 6.0) form a crank & slider linkage. This crank & slider linkage is connected in series with a four-bar linkage formed by the rotating effort arm assembly (assembly 2.0), the rotating weight arm assembly (assembly 3.0), the connecting link joining them (part 4.0), and the frame of the machine (assembly 1.0). Together the lengths and orientations of the component members of the crank & slider linkage and the four-bar linkage have been determined, for each respective configuration, through kinematic analysis to apply, when acting in conjunction with the sinusoidally changing value of force applied by the machine's rotating weight arm as the weights swing through a circular path through the gravitational field, the pre-determined variably resistive force shown in the respective graphs in FIG. 6. As shown in the graphs, the force applied, which corresponds to the normal strength-to-position force-applying capabilities of the average operator in the respective leg press exercise movement, varies as a function of the position of the guided-carriage assembly.

CONCLUSION

This invention, through the use of only rigid drive members, applies a resistive force to an operator's thigh and hip extending muscles without the use of cams, chains, or cables, as is conventional. Furthermore, by kinematically determining the specific lengths and orientations of the component members of this machine's moving parts, a variably resistive force is applied to the operator's exercising muscles which more closely corresponds to the normal strength-to-position force-applying capabilities of the average operator in the leg press exercise movement. Finally, this machine has only five moving parts and six pivotal joints making it inherently more reliable, less noisy, and more friction free than a comparable machine using cams, chains, or cables.

Having thus described the invention and its function what is claimed is as follows:

1. A carriage-type leg press exercise machine which simultaneously develops an operator's leg and hip extending muscles through applying parallel pairs of colinear resistive forces to the operator's hip and ankle joints which tend to make these two pairs of joints move toward each other along the lines between them, comprising:

a rigid frame which includes means for fixing the positions of one of said two pairs of joints;

a carriage assembly which is slideably mounted to said frame so as to move along a fixed path;

said carriage assembly includes contact surfaces which engage the operator's body so as to transmit resistive force from the carriage assembly to the operator's opposite, non-constrained, said pair of joints along said fixed path;

a rigid rotating effort arm assembly which is journaled in said frame on a first horizontal axis which is perpendicular with and offset from the fixed path said carriage assembly moves along;

a rigid rotating weight arm assembly which is journaled in said frame on a second horizontal axis which is parallel with and separated by a specific distance from said first horizontal axis;

said rotating weight arm assembly includes means for loading weights onto at a point offset from said second horizontal axis;

said rotating effort arm assembly and said rotating weight arm assembly are mechanically linked to each other at third and fourth horizontal axes which are both parallel with and offset by specific distances from said first and second horizontal axes respectively, by a first rigid connecting link which has a specific length between its centers of connection;

said rotating effort arm assembly and said carriage assembly are mechanically linked to each other by a second rigid connecting link which is pivotally connected at one end to said rotating effort arm assembly and at its other end to said carriage assembly to form a crank and slider linkage assembly, thereby when movement is imparted to said carriage assembly by said operator said second link will cause said rotating effort arm assembly to rotate about said first horizontal axis which will cause said first link to rotate said rotating weight arm assembly about said second horizontal axis which will cause said weights to rotate upward through a circular path through the gravitational field;

said rotating effort arm assembly, said rotating weight arm assembly, said first link, and said frame of said exercise machine join together to form a four-bar linkage system which functions in conjunction with both the rotating weight arm assembly and the crank & slider linkage assembly to provide a variably resistive force at said operator-engaging contact surfaces on said carriage assembly, which force varies as a function of the position of said carriage assembly.

2. The exercise machine of claim 1 in which:

the frame of said machine includes means for fixing the positions of the operator's ankle joints through the use of an integral foot-engaging platform which engages and applies constraining force to the operator's feet while in the standing operating position;

the carriage assembly includes means for transmitting resistive force to the operator's non-constrained hip joints through the use of integral contact surfaces which engage the tops of the operator's shoulders and the length of the operator's back while in the straight spine position.

3. The exercise machine of claim 1 in which:

the frame of said machine includes means for fixing the positions of the operator's hip joints through the use of integral seat and back engaging support pads which engage the operator's back and seat and apply constraining forces to the same while in a seated operating position;

the carriage assembly includes means for transmitting resistive force to the operator's non-constrained ankle joints through the use of an integral foot-engaging platform which engages the operator's feet while in the seated operating position.

* * * * *